US010760269B2

(12) United States Patent
Lundell et al.

(10) Patent No.: US 10,760,269 B2
(45) Date of Patent: Sep. 1, 2020

(54) RETAINING WALL BLOCK AND RETAINING WALL BLOCK SYSTEM

(71) Applicants: Robert John Lundell, Stillwater, MN (US); Craig D. Moritz, Vadnais Heights, MN (US)

(72) Inventors: Robert John Lundell, Stillwater, MN (US); Craig D. Moritz, Vadnais Heights, MN (US)

(73) Assignee: KEYSTONE RETAINING WALL SYSTEMS LLC, West Chester, OH (US)

( * ) Notice: Subject to any disclaimer, the term of this patent is extended or adjusted under 35 U.S.C. 154(b) by 0 days.

(21) Appl. No.: 16/166,533

(22) Filed: Oct. 22, 2018

(65) Prior Publication Data

US 2019/0119915 A1 Apr. 25, 2019

Related U.S. Application Data

(60) Provisional application No. 62/576,939, filed on Oct. 25, 2017.

(51) Int. Cl.
*E04C 1/39* (2006.01)
*E04B 2/02* (2006.01)
(Continued)

(52) U.S. Cl.
CPC ..... *E04C 1/395* (2013.01); *E02D 29/025* (2013.01); *E04B 2/02* (2013.01); *E04B 2/50* (2013.01);
(Continued)

(58) Field of Classification Search
CPC ... E04C 1/395; E04B 2/50; E04B 2/02; E04B 2/46; E04B 2002/0265; E04B 2002/0217; E02D 29/025
See application file for complete search history.

(56) References Cited

U.S. PATENT DOCUMENTS 5,214,898 A 6/1993 Beretta
D350,402 S 9/1994 Pribyl et al.
(Continued)

FOREIGN PATENT DOCUMENTS

KR 300513040.0000 12/2008

OTHER PUBLICATIONS

Keystone Construction Manual Nov. 1, 2017.

*Primary Examiner* — Basil S Katcheves
*Assistant Examiner* — Omar F Hijaz
(74) *Attorney, Agent, or Firm* — Popovich, Wiles & O'Connell, P.A.

(57) ABSTRACT

A wall block having a block body and a vertical plane of symmetry. The block body having a front portion, a rear portion and a neck portion. The wall block including a core extending through the neck portion and dividing the neck portion into first and second neck wall members extending rearward from the front portion to the rear portion. The wall block having a flange extending downward from the block body. The wall block having a channel positioned in the rear portion of the block body. The wall block having a first plane parallel to the plane of symmetry that passes through the first neck wall member and a second plane parallel to the plane of symmetry that passes through the second neck wall member, the first and second planes being located approximately midway between the plane of symmetry and the lateral outermost points of the wall block.

15 Claims, 7 Drawing Sheets

(51) Int. Cl.
*E02D 29/02* (2006.01)
*E04B 2/50* (2006.01)
*E04B 2/46* (2006.01)

(52) U.S. Cl.
CPC ..... *E04B 2/46* (2013.01); *E04B 2002/0217* (2013.01); *E04B 2002/0265* (2013.01)

(56) References Cited

U.S. PATENT DOCUMENTS

D363,787 S 10/1995 Powell
D391,376 S 2/1998 Strand et al.
5,827,015 A 10/1998 Woolford et al.
D405,543 S 2/1999 Shillingburg
D433,158 S 10/2000 Hammer
D435,917 S 1/2001 Hammer
D466,228 S 11/2002 Hammer
6,536,994 B2 3/2003 Race
D475,143 S 5/2003 Hammer
D479,003 S 8/2003 Nordstrand
6,615,561 B2 9/2003 MacDonald et al.
6,682,269 B2 * 1/2004 Price ..... E02D 29/025 405/284
6,701,687 B1 3/2004 Shillingburg
7,048,472 B2 5/2006 Woolford et al.
7,114,887 B1 10/2006 Rainey
7,168,892 B1 1/2007 MacDonald et al.
D538,947 S 3/2007 Price
D539,438 S * 3/2007 Price ..... D25/113
D556,919 S 12/2007 Price et al.
D575,413 S 8/2008 Hammer et al.
D587,382 S 2/2009 Wauhop
D602,171 S 10/2009 Rodebaugh et al.
D604,865 S 11/2009 Rainey
7,654,776 B2 2/2010 MacDonald et al.
D620,615 S 7/2010 MacDonald et al.
D621,070 S 8/2010 MacDonald et al.
7,871,223 B2 * 1/2011 MacDonald ..... E02D 29/0225 405/284
D647,218 S 10/2011 MacDonald
D647,219 S 10/2011 MacDonald
D663,858 S 7/2012 MacDonald
D671,657 S 11/2012 MacDonald
D685,502 S 7/2013 MacDonald
D688,816 S 8/2013 MacDonald
D689,203 S 9/2013 MacDonald
D689,204 S 9/2013 MacDonald
D694,914 S 12/2013 MacDonald
D708,765 S 7/2014 MacDonald
D773,693 S 12/2016 Karau
9,574,317 B2 2/2017 MacDonald
D812,781 S 3/2018 MacDonald et al.
D846,760 S 4/2019 Lundell et al.
2006/0110223 A1 5/2006 Dawson et al.
2006/0171784 A1 8/2006 Shaw
2009/0103987 A1 * 4/2009 MacDonald ..... B28B 7/0041 405/284
2009/0308015 A1 12/2009 MacDonald et al.
2011/0078978 A1 4/2011 Wauhop
2011/0217127 A1 9/2011 MacDonald
2011/0243669 A1 10/2011 Friederichs et al.
2013/0067845 A1 3/2013 MacDonald et al.
2018/0023303 A1 1/2018 MacDonald et al.

* cited by examiner

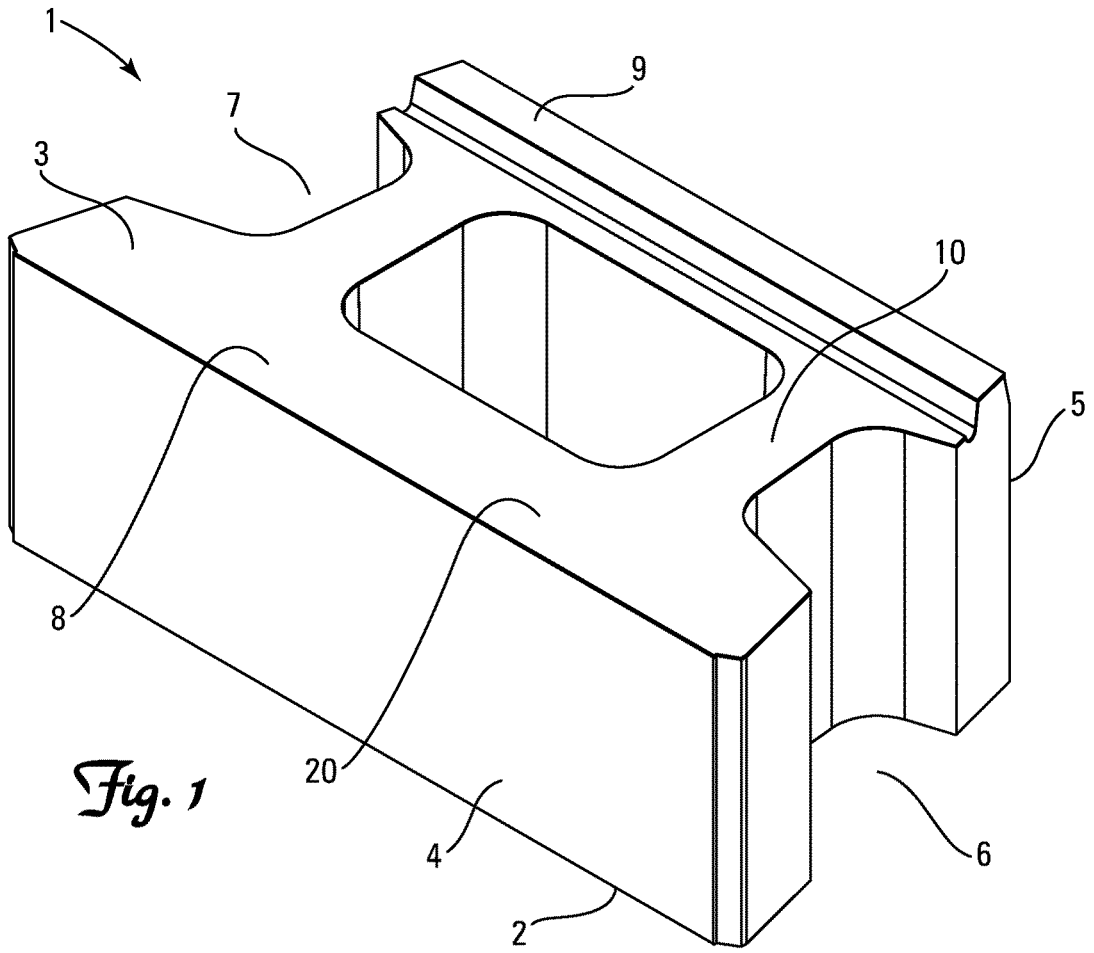
Fig. 1
Fig. 2
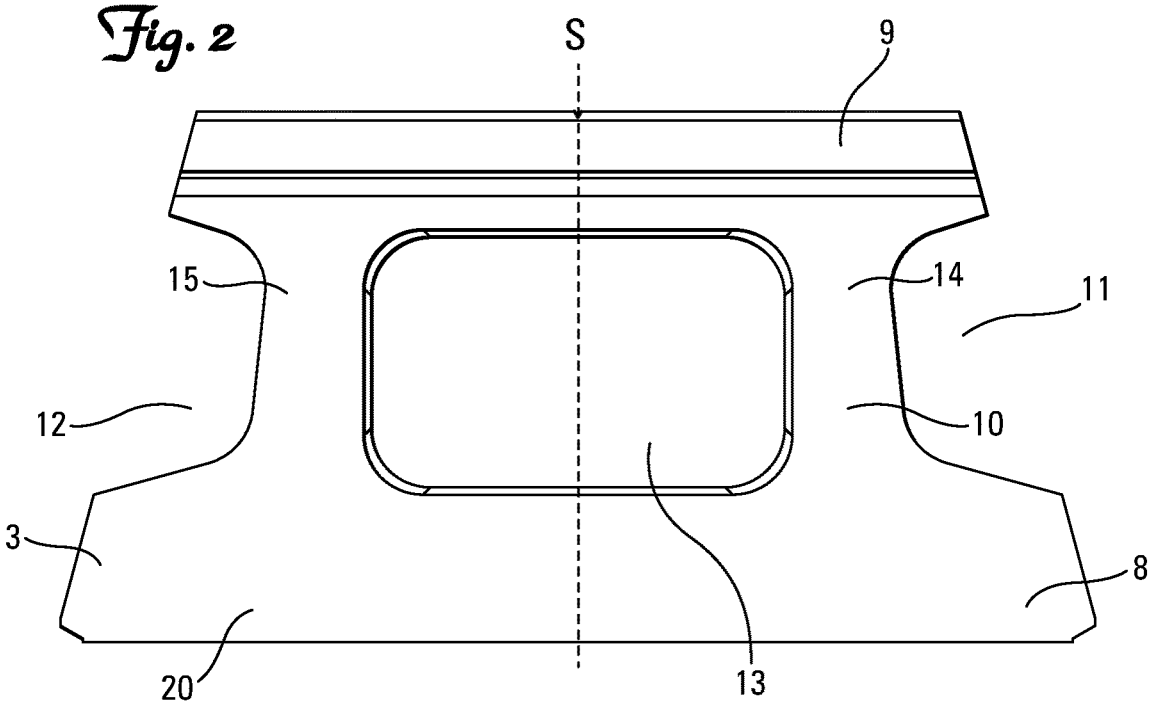

RETAINING WALL BLOCK AND RETAINING WALL BLOCK SYSTEM

FIELD OF THE INVENTION

The present invention relates generally to retaining wall blocks, retaining wall block systems, retaining walls constructed from such blocks and methods of constructing a retaining wall from the retaining wall block system. In particular, the invention relates to a retaining wall block having a connection system utilizing a flange to secure and set back courses of blocks to adjacent courses of blocks to form walls that are straight, curvilinear, retaining or free-standing and/or that have 90 degree corners.

BACKGROUND TO THE INVENTION

Numerous methods and materials exist for the construction of retaining walls. Such methods include the use of natural stone, poured in place concrete, masonry, and landscape timbers or railroad ties. In recent years, segmental concrete retaining wall units which are dry stacked (i.e., built without the use of mortar) have become a widely accepted product for the construction of retaining walls. Such products have gained popularity because they are mass produced, and thus relatively inexpensive. They are structurally sound, easy and relatively inexpensive to install, and couple the durability of concrete with the attractiveness of various architectural finishes.

Typically, retaining walls are constructed with multiple courses of blocks. The various courses may be tied together or connected in some manner. For example, numerous block designs have used a sheer connector embodied in the blocks shape to align the blocks with a setback, or batter. A common form of such sheer connectors is a rear, downwardly projecting lip or flange. In forming a multi-course wall, the blocks are placed such that the flanges contact the upper back edge of the blocks located in the course below. As such, blocks having flanges are caused to become aligned with the blocks position below, while at the same time providing a degree of resistance against displacement of individual blocks by earth pressures. In walls formed using blocks of this type, the rear flanges of the blocks cause the wall to have a setback from course to course such that the wall slopes backward at an angle which is predetermined by the width of the flanges. However, blocks with flange connection and setback means are susceptible to having the flange crack or break away from the block due to forces and pressures caused by debris and/or excess material buildup that accumulates between courses of blocks adjacent the flange. The cracking or breaking away of the flange destabilizes the structure and can result in the displacement of blocks within the structure; cracks to form in individual blocks of the structure; and the potential collapse of portions or all of the structure.

It would be desirable to provide a retaining wall block system having a flange connection means that would minimize or eliminate any cracking or breakage caused by debris or excess material buildup adjacent the flange between courses of blocks in a retaining wall. It would be desirable to provide a retaining wall block system having a flange connection means that would minimize or eliminate the ability of retaining forces acting on a block in a course of blocks in a structure to pivot upward (skyward). It would be desirable to provide a retaining wall block system having a flange connection means that would allow for the flange to be more readily broken away cleanly and completely from the block body, eliminating/reducing any excess material that may extend below the bottom face of the block. It would be desirable to provide a method of manufacturing a retaining wall block having a flange connection means that would minimize or eliminate deformation of the flange and to prevent the formation of sharpened edges or burs. It would further be desirable to provide a retaining wall block system having a flange connection means that would form continuous vertical cavities from the uppermost course of retaining wall blocks to the lowermost course of retaining wall blocks to allow stabilizing material to be inserted within the retaining wall to further strengthen the structure.

SUMMARY OF THE INVENTION

A wall block that includes a block body having top and bottom faces, a front face, a rear face, first and second side wall faces and a vertical plane of symmetry extending between the front and rear faces. The block body having a front portion including the front face, a rear portion including the rear face, a neck portion connecting the front portion and the rear portion, the front, rear and neck portions each extending between the top and bottom faces and between the first and second side wall faces. The wall block including a core extending through the neck portion from the top face to the bottom face, the core dividing the neck portion into first and second neck wall members extending rearward from the front portion to the rear portion. The wall block including a flange extending downward from the block body beyond the bottom face, the flange extending from the first side wall face to the second side wall face, the flange being positioned on the rear portion of the block body. The flange having a front surface, a back surface and a lower surface. The wall block including a channel positioned in the rear portion of the block body and extending from the first side wall face to the second side wall face and opening onto the bottom face, the first side wall face and the second side wall face. The channel having a front surface, an upper surface and a rear surface, the rear surface of the channel being formed by the front surface of the flange. The neck wall members of the wall block being positioned such that a first plane extending parallel to the plane of symmetry passes through the first neck wall member and a second plane extending parallel to the plane of symmetry passes through the second neck wall member and wherein the first and second planes are located approximately midway between the plane of symmetry and lateral outermost points of the first and second side wall faces, respectively.

A retaining wall block system including a plurality of wall blocks having a block body with top and bottom faces, a front face, a rear face, first and second side wall faces and a vertical plane of symmetry extending between the front and rear faces. The block body having a front portion including the front face, a rear portion including the rear face, a neck portion connecting the front portion and the rear portion, the front, rear and neck portions each extending between the top face and the bottom face and between the first and second side wall faces. The front portion having first and second ears extending laterally beyond the first and second neck wall members, respectively and the rear portion having first and second ears extending laterally beyond the first and second neck wall members, respectively, the laterally extending first ears of the front and rear portions and the inset first neck member of the first side wall face creating a first side wall indentation and the laterally extending second ears of the front and rear portions and the inset second neck member of the second side wall face creating a second side wall indentation. The plurality of retaining wall blocks having a core extending through the neck portion from the top face to the bottom face, the core dividing the neck portion into first and second neck wall members extending rearward from the front portion to the rear portion. The neck wall members being positioned such that a first plane extending parallel to the plane of symmetry passes through the first neck wall member and a second plane extending parallel to the plane of symmetry passes through the second neck wall member, the first and second planes being located approximately midway between the plane of symmetry and lateral outermost points of the first and second side wall faces, respectively. The plurality of retaining wall blocks having a flange extending downward beyond the block body past the horizontal plane of the bottom surface, the flange extending from the first side wall face to the second side wall face, the flange positioned on the rear portion of the block body. The flange having a front surface, a back surface and a lower surface. The plurality of retaining wall blocks having a channel extending upward into the rear portion of the block body and extending from the first side wall face to the second side wall face and opening to the bottom face, the first side wall face and the second side wall face and the flange. The channel having a front surface, an upper surface and a rear surface. The first and second neck wall members of the retaining wall blocks are configured to align, in use, with the neck wall member of a vertically adjacent block in an adjacent course of a wall made from a plurality of courses of the blocks and the core of a block in a course of the wall is configured to align, in use, with the side wall indentations of a vertically adjacent course of blocks to create retaining wall cavities in the retaining wall that are continuously open from the uppermost course of the retaining wall to the lowermost course of the retaining wall.

A method of constructing a retaining wall from a retaining wall block system including providing a plurality of wall blocks having a block body with top and bottom faces, a front face, a rear face, first and second side wall faces and a vertical plane of symmetry extending between the front and rear faces. The block body of the plurality of wall blocks having a front portion including the front face, a rear portion including the rear face, a neck portion connecting the front portion and the rear portion, the front, rear and neck portions each extending between the top face and the bottom face and between the first and second side wall faces. The front portion having first and second ears extending laterally beyond the first and second neck wall members, respectively and the rear portion having first and second ears extending laterally beyond the first and second neck wall members, respectively, the laterally extending first ears of the front and rear portions and the inset first neck member of the first side wall face creating a first side wall indentation and the laterally extending second ears of the front and rear portions and the inset second neck member of the second side wall face creating a second side wall indentation. The plurality of wall blocks having a core extending through the neck portion from the top face to the bottom face, the core dividing the neck portion into first and second neck wall members extending rearward from the front portion to the rear portion, the neck wall members being positioned such that a first plane extending parallel to the plane of symmetry passes through the first neck wall member and a second plane extending parallel to the plane of symmetry passes through the second neck wall member, the first and second planes being located approximately midway between the plane of symmetry and lateral outermost points of the first and second side wall faces, respectively. The plurality of wall blocks having a flange extending downward beyond the block body past a horizontal plane of the bottom surface, the flange extending from the first side wall face to the second side wall face, the flange positioned on the rear portion of the block body, the flange having a front surface, a back surface and a lower surface. The plurality of wall blocks having a channel extending upward into the rear portion of the block body and extending from the first side wall face to the second side wall face and opening to the bottom face, the first side wall face and the second side wall face and the flange, the channel having a front surface, an upper surface and a rear surface. The method including positioning a first plurality of retaining wall blocks to form at least a portion of a first course of blocks. The method including stacking a second plurality of retaining wall blocks to form at least a portion of a second course of blocks, the flange of the blocks of the second course contacting the rear face of the blocks of the second course to secure and connect the first course to the second course. The first and second neck wall members of the retaining wall blocks in each course are configured to align with the neck wall member of retaining wall blocks in an adjacent course and at least some of the cores of the retaining wall blocks in each course are configured to align with at least some of the side wall indentations of the retaining wall blocks in each adjacent course to create retaining wall cavities in the retaining wall that are continuously open from an uppermost course of the retaining wall to a lowermost course of the retaining wall.

BRIEF DESCRIPTION OF THE DRAWINGS

A preferred form of the present invention will now be described by way of example with reference to the accompanying drawings, wherein:

FIG. 1 is a bottom perspective view of a retaining wall block of the present invention.

FIG. 2 is a bottom plan view of the retaining wall block of FIG. 1.

DETAILED DESCRIPTION OF PREFERRED EMBODIMENTS

Figure 3:
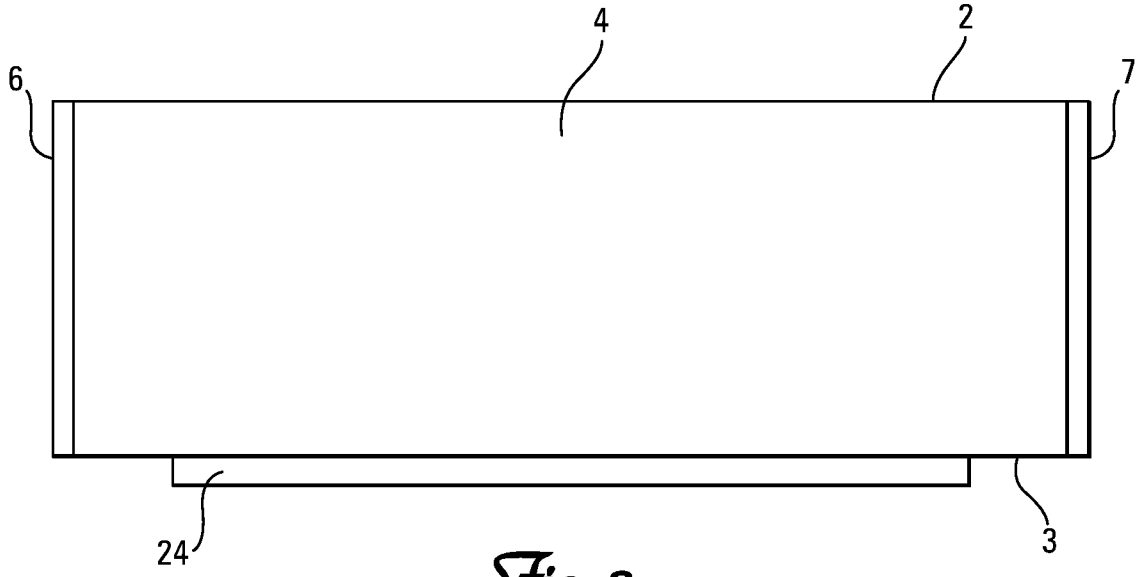
FIGS. 3 and 4 are front and rear views, respectively, of the retaining wall block of FIG. 1.
Figure 4:
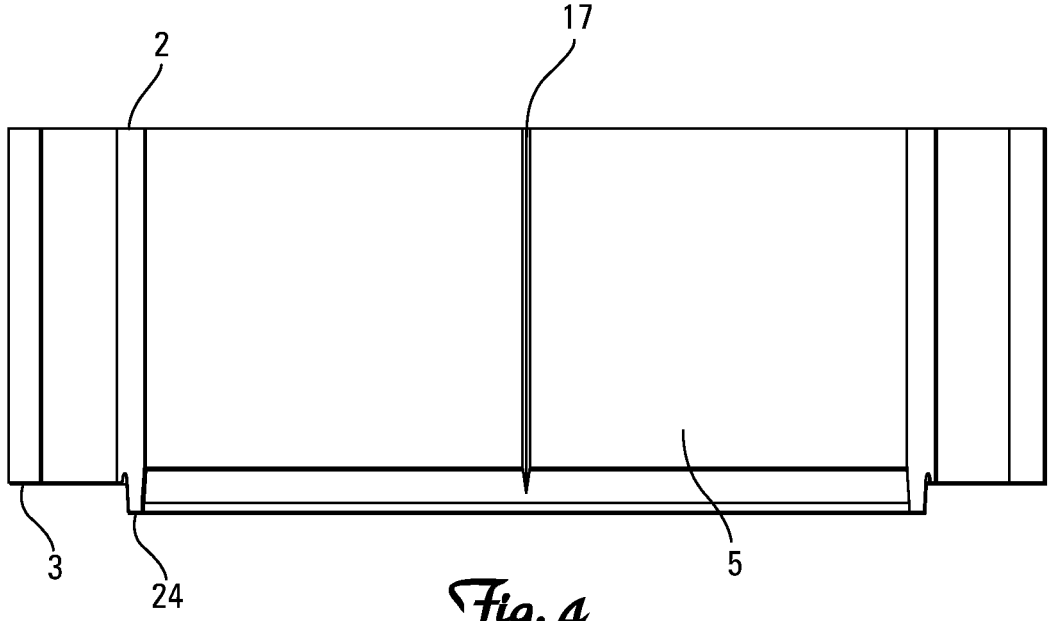

Retaining wall blocks of the present invention can be made of a rugged, weather resistant material, preferably dry cast or wet cast molded concrete. Other suitable materials include polymers, especially high density foam polymers, fiberglass, wood, metal, glass, stone, and composite materials with reinforced fibers, etc. The blocks may have various shapes and characteristics, as known in the art, and may be stacked one upon the other so that they are angled or set back from vertical. The blocks may be provided with one or more protruding elements that interlock with the rear surface of a block in an adjacent course of blocks.

"Upper" and "lower" refer to the placement of the block in a retaining wall or other structure. The lower, or bottom, surface is placed such that it faces the ground. In a retaining wall, one row of blocks is laid down, forming a course. An upper course is formed on top of this lower course by positioning the lower surface of one block on the upper surface of another block, typically in a running or half bond pattern and not in a stacked pattern.

Retaining walls may be straight (i.e., substantially linear), curved (concave, convex, or serpentine) or may have angled corners (i.e., 90 degree angles, obtuse angles or acute angles of a buildable degree). Such walls can be angled or setback from vertical. The blocks of this invention may be symmetrical about a vertical plane of symmetry. The blocks may be provided with cores and side voids which serve to decrease the weight of the block while maintaining its strength and also providing ease of construction when building the structure. The location, shape, and size of the cores and side voids are selected to maximize the strength of the block, as described by reference to the drawings.

Referring to FIGS. 1 to 7, there is shown retaining wall block 1 according to a preferred embodiment of the present invention. Block body 20 of block 1 includes top face 2, bottom face 3, front face 4, rear face 5 and first and second side wall faces 6 and 7. Front face 4 and rear face 5 each extend from top face 2 to bottom face 3. Side wall faces 6 and 7 each extend from top face 2 to bottom face 3 and each extend from front face 4 to rear face 5. Block 1 is generally symmetrical about vertical plane of symmetry S. Rear face 5 may be provided with optional notch 17 that can provide a half-block locator mark and also a weakened block point for field splitting the block when constructing a wall (not shown in FIG. 1).

Block body 20 of block 1 includes front portion 8, rear portion 9 and neck portion 10. Neck portion 10 connects front portion 8 to rear portion 9. Front face 4 forms part of front portion 8, while rear face 5 forms part of rear portion 9. The front, rear and neck portions 8, 9, and 10, respectively, each extend between top and bottom faces 2 and 3 and between first and second side wall faces 6 and 7. Side wall faces 6 and 7 are thus of a compound shape and define side voids 11 and 12 which are located between front and rear portions 8 and 9 and on the exterior facing sides of neck portion 10. Side voids 11 and 12 are a result of the reduced width of neck portion 10 compared to that of front and rear portions 8 and 9. Block body 20 also includes opening or core 13 that extends through neck portion 10 from top face 2 to bottom face 3, separating front portion 8 from rear portion 9. Opening or core 13 divides neck portion 10 into first and second neck wall members 14 and 15 which extend rearward from front portion 8 to rear portion 9. Opening 13 and side voids 11 and 12 reduce the weight of block 1, facilitating handling thereof while also serving to reduce the amount of material necessary for producing the block.

Figure 5:
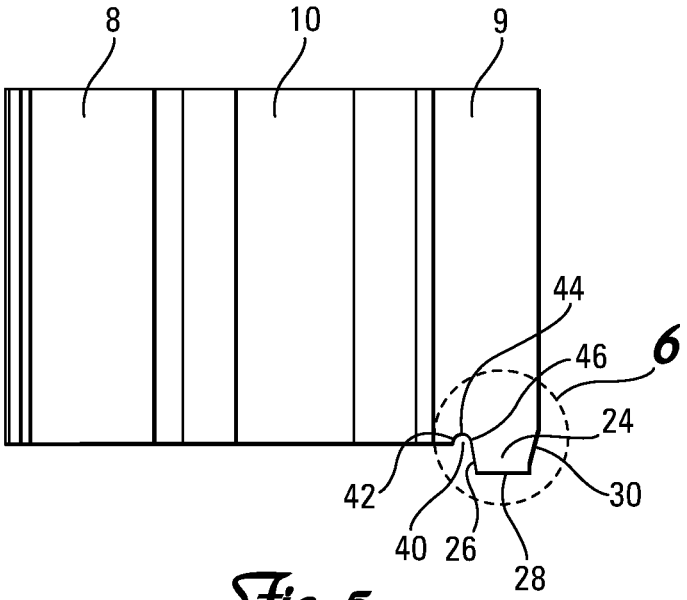
FIG. 5 is a side view of the retaining wall block of FIG. 1.

FIG. 5 shows flange or lip 24 of block 1 positioned on rear portion 9 and extending downward beyond the block body past a horizontal plane of bottom face 3. Flange or lip 24 may extend from side wall face 6 to side wall face 7. It should be understood that flange 24 could be segmented or could extend any distance along the bottom of the block body from side wall face 6 to side wall face 7 and could be positioned anywhere on the rear portion of the block body, as desired. The flange has a front surface 26, a lower surface 28 and a back surface 30. Back surface 30 may extend continuously from the rear face 5 of block body 20 to lower surface 28 of flange 24. The purpose of the rear flange is to provide both a desired amount of setback between courses of blocks in a retaining wall and a means of securing one course of blocks above a lower course of blocks in a retaining wall to help prevent block displacement due to pressures from the earth or backfill behind the wall. As such, the size of the flange may be selected to accomplish these desired objectives and could have any desired dimension depending upon the application. For example, flange 24 may extend ¼ to 1 inch below bottom face 3 of block body 20 and may extend ½ inch below bottom face 3. Lower surface 28 of the flange may have a width as measured from front surface 26 to back surface 30 of approximately ½ inch to 1½ inches and may have a width of ⅞ inch. Front surface 26 and back surface 30 of the flange may angle toward each other as each extends downward from the block body such that the flange has a taper that narrows or converges from the block body to lower surface 28. Hence, the upper portion of the flange may have a maximum width as measured from the front surface to the back surface along the block body that is ⅞ inch to 1½ inches to a minimum width along the lower surface of the flange that may be ½ to ⅞ of an inch. It should be understood that the size, shape and dimensions of the flange are not limiting and that the flange could have front and back surfaces that are vertical and parallel to each other and/or each surface could be any size or dimension as desired.

FIG. 5 also shows channel 40 of block 1 extending upward into block body 20 inside rear portion 9, beyond the bottom face 3 of block body 20. Channel 40 may extend from side wall face 6 to side wall face 7. It should be understood that channel 40 could be segmented or could extend any distance along the block from side wall face 6 to side wall face 7 and could be positioned anywhere inside the rear portion of the block, as desired. The channel has a front surface 42, upper surface 44 and a back surface 46. The purpose of the channel is to provide the flanged setback between courses of blocks in a retaining wall a space or void for any excess material or debris to accumulate during and/or after the construction of a wall. As a block is positioned on a lower course of block, excess material or debris may be trapped between the courses of block adjacent the flange of the block in the upper course. That material or debris can exert a force on the flange that, over time, may cause it to crack or break away from the block body, reducing or eliminating the securement of the block within the course and within the wall, thus decreasing the overall stability of the structure. The channel allows the excess material or debris a place to accumulate when the block is positioned, such that, the material or debris is now trapped in the channel between the courses of the block, reducing or eliminating the exertion of force on the flange of the block in the upper course. Additionally, in some applications, the flange of the block may need to be removed, knocked off or broken away from the block body. The channel provides a depressed surface into the block body that allows for the flange to be more readily broken away cleanly and completely from the block, eliminating/reducing any excess material that may extend below the bottom face of the block. Also, the channel and the front surface of the flange are configured to eliminate/reduce the ability of retaining forces acting on a block in a course of blocks in a structure to pivot the block upward (skyward). The reduction or elimination of the ability of retaining forces acting on a structure to pivot the blocks in each individual course of a structure enhances the overall strength and durability of the structure and also increases the overall aesthetic of the structure. As such, the size and depth of the channel may be selected to accomplish these and other desired objectives. For example, channel 40 may have a height as measured from bottom face 3 to the apex or uppermost part of the channel that is ⅛ to ½ inch, or that can be any other desired dimension depending upon the application. Further, channel 40 may have a width as measured from bottom face 3 to flange 24 that is ⅛ to 1 inch, or that can be any other desired dimension depending upon the application.

Figure 6:
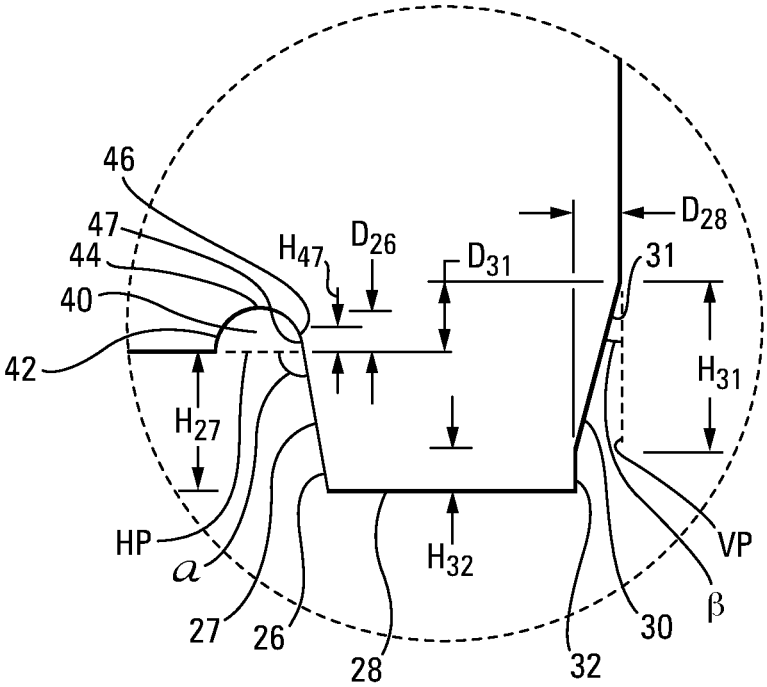
FIG. 6 is an exploded view of a portion of FIG. 5.

FIG. 6, which is an exploded view of a portion of FIG. 5, shows flange 24 having front surface 26, lower surface 28 and back surface 30. Front surface 26 of flange 24 is in closer proximity to front face 4 than back surface 30 is to front face 4, and back surface 30 of flange 24 is in closer proximity to rear face 5 than front surface 26 is to rear face 5. Lower surface 28 of flange 24 is the lowermost surface of the block. Front surface 26 has angular planar surface 27 that is adjacent channel 40 and extends at an angle from the horizontal plane HP of bottom face 3. Angular planar surface 27 may angularly extend at any desired angle from the horizontal plane of bottom face 3. Angular planar surface 27 of flange 24 has an optimally desired angle of extension a from the horizontal plane of bottom face 3 to eliminate/reduce the ability of retaining forces acting on the block as it is positioned in a course of blocks in a structure to pivot the block upward (skyward). The reduction or elimination of the ability of retaining forces acting on the block in a structure to pivot each block in each individual course of a structure, enhances the overall strength and durability of the structure and also increases the overall aesthetic of the structure. The optimally desired angle of extension a of angular planar surface 27 may be in a range from 95° to 105° from the horizontal plane HP of bottom face 3, and may extend at a desired angle of 100°. Additionally, angular planar surface 27 could extend 90° from horizontal (perpendicular to the horizontal plane HP of bottom face 3). Angular planar surface 27 has a height H27 as measured from the horizontal plane HP of bottom face 3 to lower surface 28 of the flange. Rear surface 30 of flange 24 has angular planar surface 31 that extends from rear face 5 of block body 20. Angular planar surface 31 may angularly extend at any desired angle β from a vertical plane VP at the uppermost point of rear face 5, and as such could extend from that vertical plane VP in a range from 5° to 15°, and may extend at a desired angle of 10°. Additionally, angular planar surface 31 could extend continuous with the vertical plane VP of rear face 5. Angular planar surface 31 has a height $H_{31}$ as measured from rear face 5 of block body 20 to vertical planar surface 32. As can be seen in FIG. 6, angular planar surface 31 may extend into the block body beyond the horizontal plane HP of bottom face 3 a distance $D_{31}$ that is greater than a distance $D_{26}$ that front surface 26 extends into the block body. Rear surface 30 also has a vertically planar surface 32 that extends from angular planar surface 31 to lower surface 28 of the flange. Vertical planar surface 32 of the rear surface of the flange has a height $H_{32}$ as measured from angular surface 31 to lower surface 28 of flange 24. Lower surface 28 may be inset from rear face 5 toward front face 4 by distance $D_{28}$.

The bottom face of the block along with the flange and channel may be formed facing upward in a mold box during the molding process of the blocks of the present invention. During the molding process, a stripper shoe descends into the mold box from a compression head as known in the art, contacting and compressing the molding material inside the mold box. Forming surfaces of the stripper shoe may mold/form the bottom face 3 of block body 20, the lower surface 28 of the flange, and the angular planar surface 27 of the flange (and depending upon the desired application, the entirety of front surface 26 of flange 24). The angular planar surface 31 and vertical planar surface 32 of back surface 30 of flange 24 may be formed by surfaces and/or liners of the mold cavity, or could be, depending upon the location of the flange relative to the block body, also formed by forming surfaces of the stripper shoe. Additionally, the channel of block 1 may be molded by forming surfaces of the stripper shoe or other processes known in the art. As the stripper shoe compacts the material in the mold box, vertical planar surface 32 may protect the front and back surfaces of the flange from possible over-travel of the stripper shoe as it descends into the mold box during the molding process, also preventing disfiguration of the flange and preventing the formation of any sharp edges or burs that could reduce the functionality of the block in a structure constructed from the block. Specifically, sharp edges or burs formed on the block could shear away, cut or damage a geogrid used with the block in the construction of a retaining structure.

Additionally during the block manufacturing process, blocks of the present invention may exit a kiln on a roller conveyor as known in the art. The blocks exiting the kiln may collide with adjacently positioned blocks on the roller conveyor due to the continual start and stop advancement of blocks on the roller conveyor as the blocks exit the kiln and as the blocks potentially undergo other optional processes. Since the blocks may not be fully cured as they exit the kiln, the collision of blocks on the roller conveyor may damage and deform the flange, particularly rear face to rear face adjacently positioned blocks. Angular planar surface 31 of rear surface 30 of flange 24 and inset lower surface 28 of flange 24, allows for a separation between the flange of a first block and the flange of a second block positioned rear face to rear face adjacent on the roller conveyor. The separation of the flanges will reduce/eliminate any collision between the flanges of adjacently positioned blocks by the start/stop motion of the roller conveyor and will also reduce/eliminate damage and deformation to the flanges during the manufacturing process.

As can also be seen in FIG. 6, channel 40 has front surface 42, upper surface 44 and back surface 46. Front surface 42 of channel 40 is in closer proximity to front face 4 than back surface 46 is to front face 4 and back surface 46 of channel 40 is in closer proximity to rear face 5 than front surface 42 is to rear face 5. Front surface 42 may have a radial, angular or vertical contour, as desired. Upper surface 44 of channel 40 is the uppermost surface of the channel extending into block body 20. Channel 40 may have a height as measured from bottom face 3 to the apex of upper surface 44 that can be any desired dimension and may be ¼ to ½ inch. Upper surface 44 may have a radial, angular or horizontal contour, as desired. Rear surface 46 has angular planar surface 47 that extends angularly from upper surface 44 to angular planar surface 27 of flange 24. Angular planar surface 47 may extend at any desired angle from upper surface 44, and as such, could extend 90° from horizontal (perpendicular to the vertical plane of bottom face 3). Angular planar surface 47 has a height $H_{47}$ as measured from upper surface 44 to the horizontal plane of bottom face 3. Angular planar surface 47 and angular planar surface 27 of flange 24 may form a continuous angular planar surface and together may both form the entirety of front surface 26 of flange 24 such that front surface 26 of flange 24 may form the back surface of channel 40.

Figure 7:
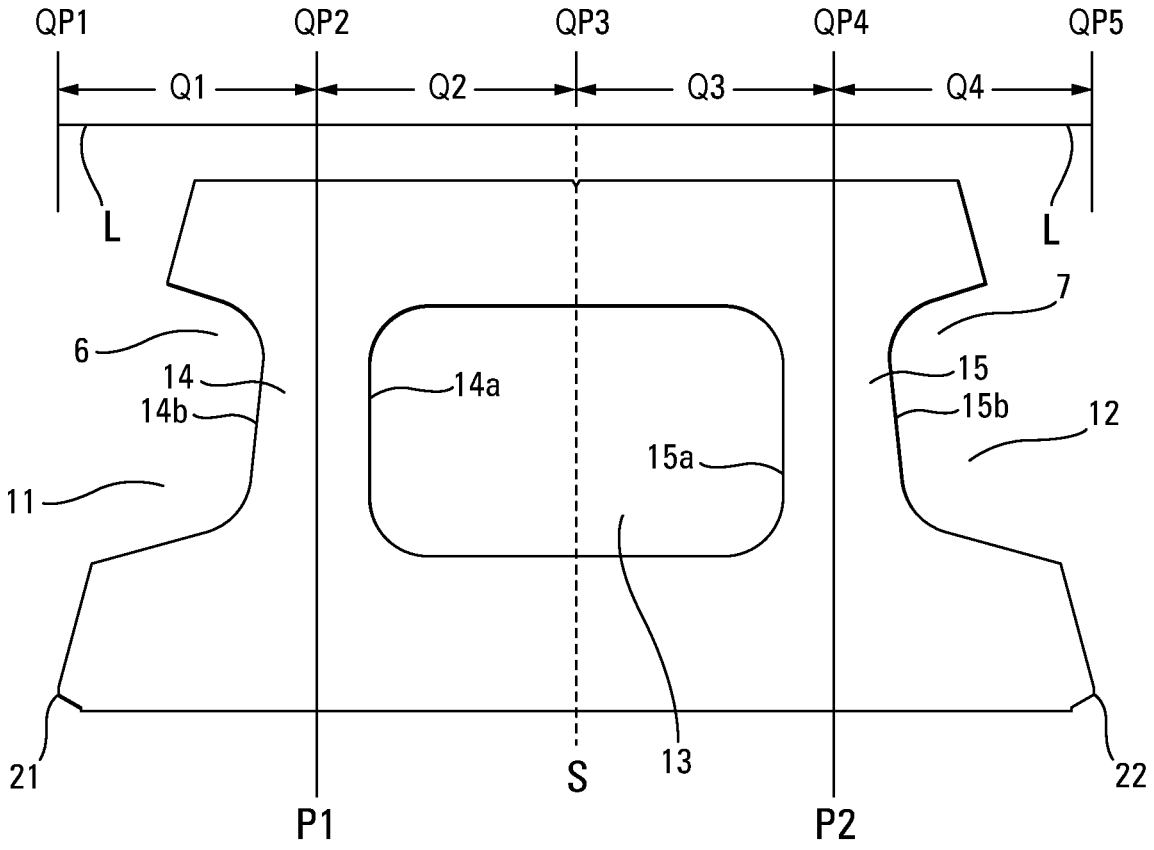
FIG. 7 is a top plan view of the retaining wall block of FIG. 1.

As can be seen in FIG. 7, neck wall members 14 and 15 are positioned such that a first plane P1 extending parallel to plane of symmetry S passes through first neck wall member 14 and such that second plane P2 extending parallel to plane of symmetry S passes through second neck wall member 15. The effect of this configuration is best described with reference to FIG. 8 which depicts first block 1A with second and third blocks 1B, 1C disposed beneath block 1A and laid in a running bond pattern with first block 1A setback from second and third blocks 1B, 1C, the predetermined setback being the width of flange 24. As can be seen, the configuration ensures that the neck wall members of vertically adjacent blocks overlap. First neck wall member 14A of first block 1A overlaps second neck wall member 15B of second block 1B, while second neck wall member 15A of first block 1A overlaps first neck wall member 14C of third block 1C. This overlap provides continuity of structure in the neck region between courses of blocks enabling transfer of compressive loads in this area through successive courses of blocks, minimizing the bridging of unsupported areas. Structural integrity of the wall can hence be achieved with a lighter mass block with opening 13 and void areas 11 and 12, as an increased proportion of the material of the block is able to transfer load between blocks.

The configuration also provides overlap between opening 13A of first block 1A and side voids 12B, 11C of second and third blocks 1B, 1C, as well as between the side voids of first block 1A and openings 13B and 13C of second and third blocks 1B, 1C. This overlap provide continuous cavities 38 in the wall which extends through successive courses of blocks, improving the ease with which the cavities can be filled with core fill material such as crushed rock to encourage drainage and add stabilizing mass to the wall or alternatively easing the placement of grout. Continuous cavities 38 may also allow for the placement of guardrail posts or fences at the top of a wall or for the reinforcement of the wall with rebar and concrete grout.

Beyond merely overlapping, first and second neck wall members 14 and 15 are positioned so that they will align (minus the amount of setback due to the flange) with the neck wall members of blocks in adjacent courses when laid in a running bond pattern. Such alignment maximizes the resistance of the blocks against crushing and sheering forces in constructed walls. This will best be achieved if first and second planes P1 and P2 run though first and second neck wall members 14 and 15, respectively. To provide such alignment and to ensure blocks disposed side by side in a given course of blocks are closely adjacent without any significant gap between them, first and second planes P1 and P2 will typically be located approximately midway between plane of symmetry S and laterally outermost points 21 and 22 of first and second side wall faces 6 and 7, respectively, as can be seen in FIG. 7. Block 1 has a maximum length L as measured from outermost point 21 to outermost point 22 and length L has four equal quarter lengths Q1, Q2, Q3, and Q4, resulting in five quarter points QP1, QP2, QP3, QP4 and QP5. Outermost point 21, first plane P1, plane of symmetry S, second plane P2 and outermost point 22 are each positioned on quarter points QP1, QP2, QP3, QP4 and QP5, respectively. Quarter length Q1 is ¼ of the maximum length L as measured from outermost point 21 to first plane P1 (QP1 to QP2); quarter length Q2 is ¼ of the maximum length L as measured from first plane P1 to line of symmetry S (QP2 to QP3); quarter length Q3 is ¼ of the maximum length L as measured from line of symmetry S to second plane P2 (QP3 to QP4); and quarter length Q4 is ¼ of the maximum length L as measured from second plane P2 to outermost point 22 (QP4 to QP5).

Neck wall members 14 and 15 may have interior walls 14*a* and 15*a* that form surfaces of opening 13 and may run parallel to the line of symmetry S and first and second planes P1 and P2. Additionally, neck wall members 14 and 15 have exterior walls 14*b* and 15*b* that from surfaces of side voids 11 and 12, respectively, and may converge from front portion 8 to rear portion 9 of block 1, such that exterior walls 14*b* and 15*b* may not be parallel to the line of symmetry S or to first and second planes P1 and P2. As such, neck wall members 14 and 15 do not extend entirely parallel to plane of symmetry S. However, neck wall members 14 and 15 will provide continuous support between vertically adjacent blocks as long as planes P1 and P2 extend the entire length of the neck wall members 14 and 15 at a location between interior walls 14*a*, 15*a* and exterior walls 14*b*, 15*b*, respectively.

Figure 8:
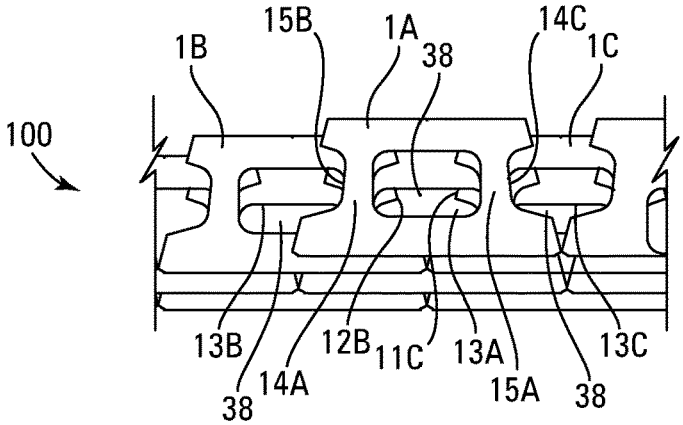
FIG. 8 is a top plan view of a portion of a wall constructed with the block of FIGS. 1 to 7.
Figure 9:
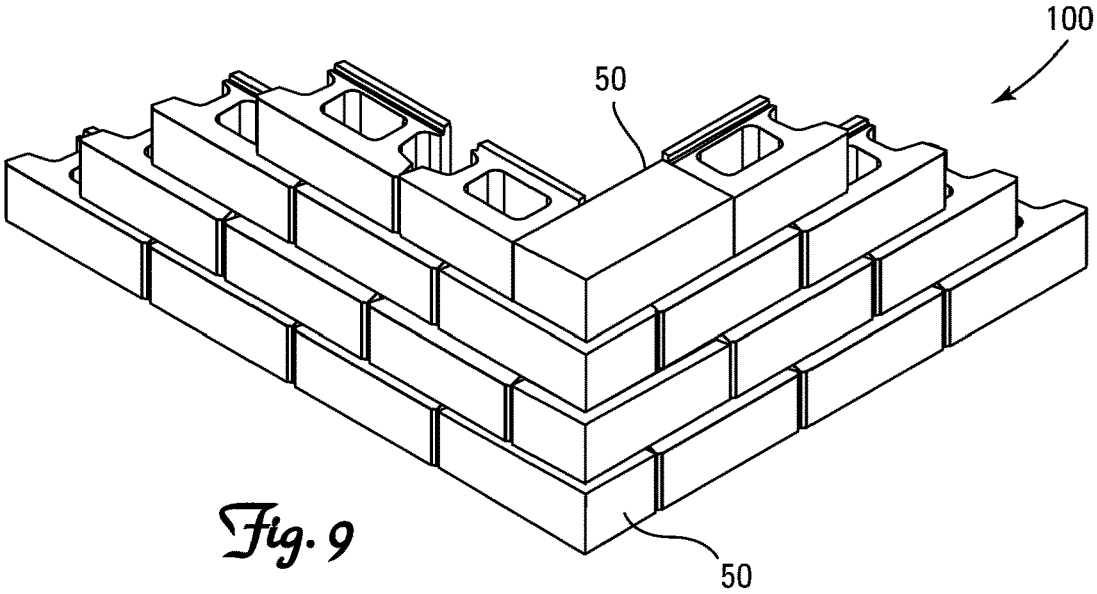
FIG. 9 is a front perspective view of a portion of a wall with a 90° corner constructed with the blocks of FIGS. 1 to 7 and with corner block 50.
Figure 10:
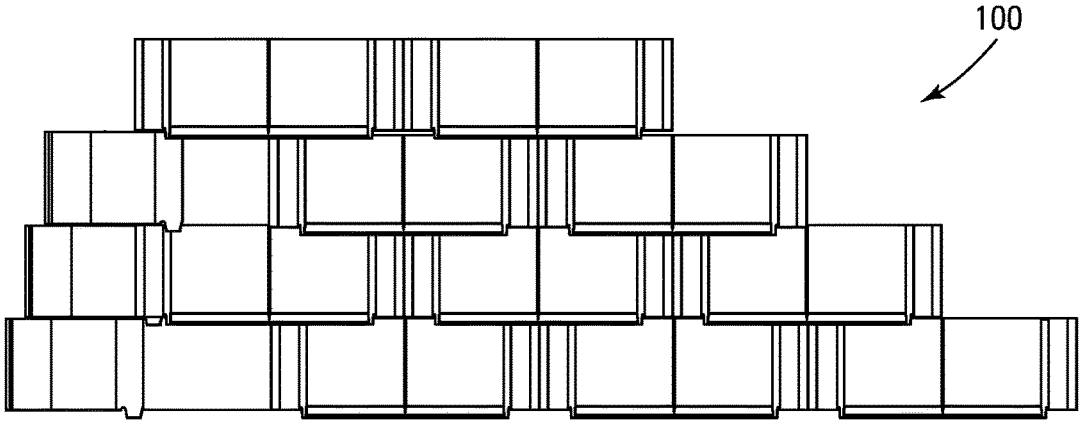
FIG. 10 is a rear elevation view of a portion of a wall constructed with the block of FIGS. 1 to 7.
Figure 11:
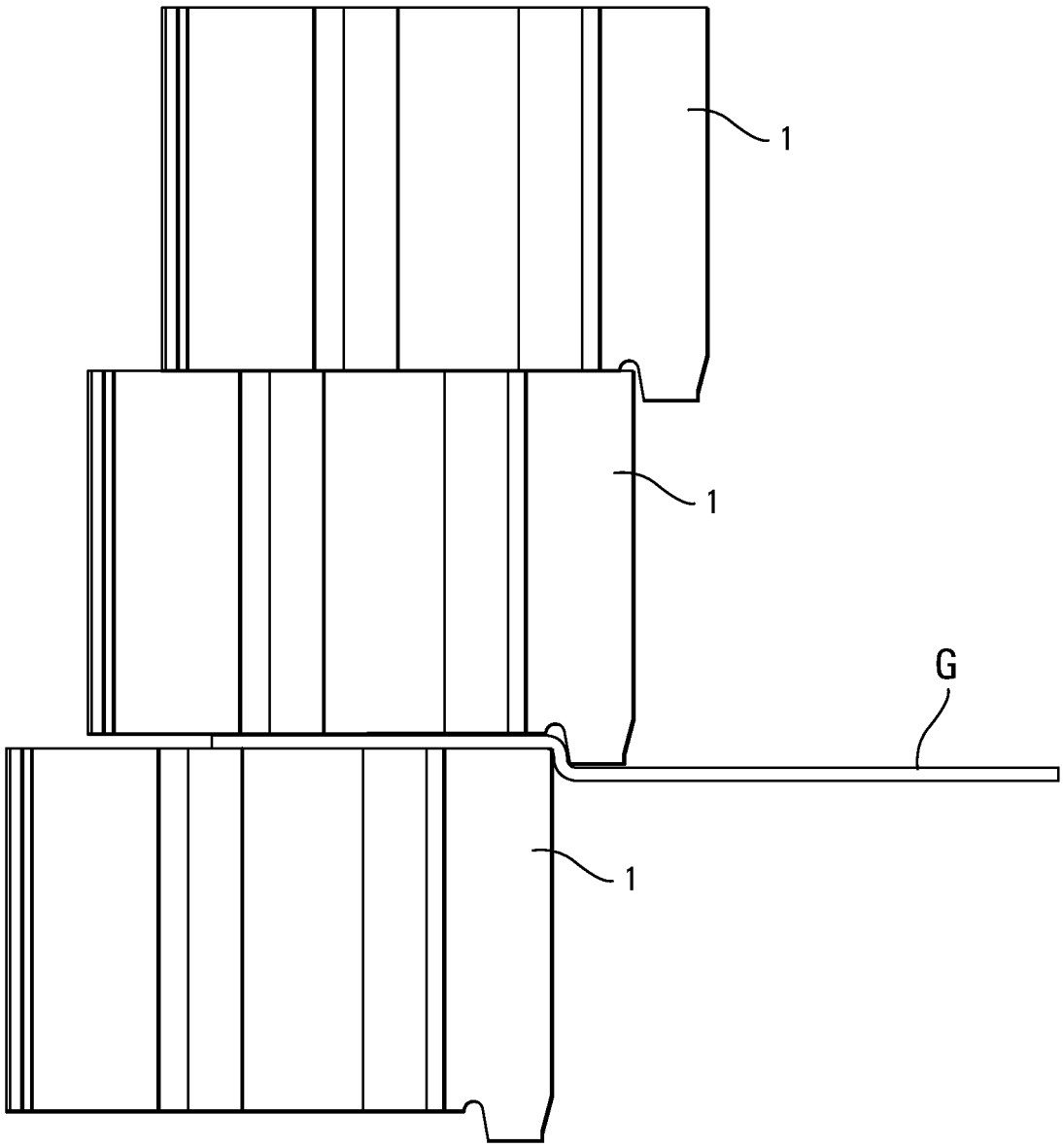
FIG. 11 is a partial side elevational view of a portion of a wall constructed with the block of FIGS. 1 to 7 showing the flange and channel securing system with geogrid stabilization/retaining means.

FIGS. 8 to 11 show retaining walls 100 constructed from blocks 1 utilizing the ledge and channel features of the block to form a stable and interconnected wall with a predetermined setback. FIG. 11 shows block 1 in an upper course of the wall positioned on a block 1 in a lower course of blocks to illustrate how the rear lip or flange of the upper course connects to the back top edge of blocks in the lower course to provide both a setback of the blocks in the upper course and a means of securing the upper course to the lower course. FIG. 11 also illustrates a course of blocks utilizing geogrid G to help stabilize/retain the earthen material behind the structure. The geogrid is stabilized/retained between courses of blocks by gravitational forces such as the weight of the blocks in a course and additionally by core fill such as gravel, sand, crushed stone or any other suitable material as known in the art that is inserted through the vertical columns created by the alignment of the cores and side voids of the blocks positioned in a structure. Additionally, rebar could be fed through the vertical columns to further stabilize/retain the geogrid. Blocks 1 may be field cut using a masonry saw or cut at the factory to be used at the lateral ends of courses of wall 100 to finish the wall in the usual manner where necessary. As seen in FIG. 9, corner blocks 50 may be used in alternating courses of length and width orientations at the corner of a wall to form the corner of a wall and to continue the running bond configuration of the left wall portion and the right wall portion relative to the 90° corner. Corner blocks 50 can be any desired shape or size depending upon the desired application and can be, as seen in FIG. 9, substantially rectangular. Corner blocks 50 could also be used as a capping block to finish off the top of the wall. The capping block could have any desired height or shape depending upon the application, and could for example have the same width and length as corner block 50 but have a smaller dimensioned height. FIG. 8 clearly depicts how alignment of the neck wall members of vertically adjacent blocks and consequent alignment of neck openings 13 with side voids 11 and 12 of vertically adjacent blocks provides continuous cavities 38 extending through the height of wall 100.

Figure 12:
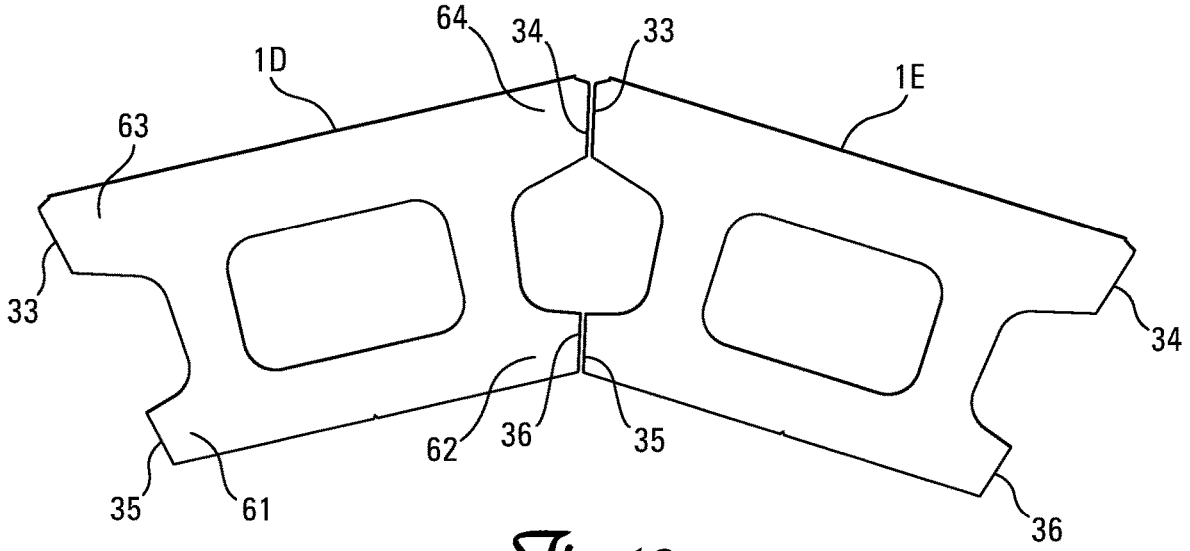
FIG. 12 is a top plan view of a portion of a convex wall constructed with the retaining wall blocks of FIGS. 1 to 7.

Block 1 of the preferred embodiment is suitable for forming straight, curved or serpentine walls. To provide for convex faced curved walls and serpentine walls, side wall faces 6 and 7 generally taper from front face 4 to rear face 5, such that the block is wider at front portion 8 between outermost points 21 and 22 than at rear portion 9. This enables the blocks to be placed in a convex curve in the usual manner without interference between the rear portions 9 of laterally adjacent blocks. FIG. 12 depicts two blocks 1D and 1E of a course laid in a convex curve. FIG. 12 also shows block body side wall surfaces 33, 34, 35 and 36 are tapered at an angle such that when a first block is positioned adjacent a second block in a course of wall having a convex curve, surfaces 34 and 36 of the first block abut surfaces 33 and 35 of the second block, respectively, creating minimal, if any, gaps between the front faces 4 of adjacently positioned blocks. To provide for increased curvature of a convex-curved section of wall, rear portion 9 is provided with first and second ears 61 and 62 extending laterally beyond first and second neck wall members 14 and 15, respectively. First and second ears 61 and 62 can be knocked off rear portion 9 when necessary. Additionally, front portion 8 is provided with first and second ears 63 and 64 extending laterally beyond first and second neck wall members 14 and 15, respectively. First and second ears 63 and 64 can be knocked off front portion 8 when necessary.

A retaining wall formed of courses of blocks 1 can be reinforced with the use of rebar and grout. Lengths of rebar can be inserted into at least one of the continuous cavities 38 defined by neck openings 13 and vertically adjacent side voids 11 and 12 of blocks in alternate courses. Cavities 38 can then be filled with grout to encase the rebar. This form of reinforcing is applicable to the setback of the wall created by flange 24, where cavities 38 defined in the wall are continuous but inclined at an angle equal to the setback angle of the wall. Alternatively, the wall may be reinforced by placing threaded rods through the cavities and using conventional post-tension techniques.

Blocks 1 are typically manufactured of concrete and cast in a high-speed masonry block or paver machine. The block may be formed with the bottom face up, to allow for forming of the channel and flange. Opening 13 and optionally side voids 11 and 12 may be formed using a core forming member that extends to the top face (which may form the bottom surface during molding). Alternatively, side voids 11 and 12 may be formed by side liners and other methods known in the art. Blocks 1 may be formed as mirror image pairs joined at the front face 4 which are then subsequently split using a standard block splitter in the usual way to provide a rough front face 4 on the split blocks 1. Alternatively, other methods may be utilized to form a variety of front face surface appearances. Such methods are well known in the art.

Figure 13:
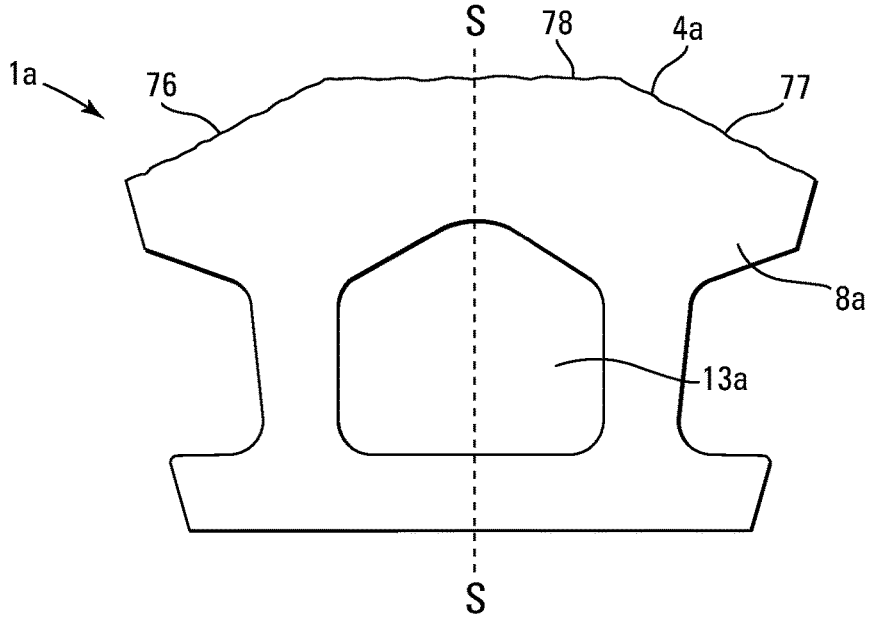
FIG. 13 is a top plan view of an embodiment of the block of FIGS. 1 to 7 showing an alternate shaped opening or core and an alternate shaped and configured front portion.

As seen in FIG. 13 block 1*a* has front face 4*a* that may be formed of angled outer surfaces 76 and 77 and central surface 78. Central surface 78 may be disposed perpendicular to plane of symmetry S, along with angled outer surfaces 76 and 77, and may provide a multi-faceted front face on a wall constructed of the blocks. Alternatively, a variety of front face designs may be used as desired. Additionally, core 13*a* has been formed with a different shape and contour. Front portion 8*a* has also been formed to have a greater surface area than front portion 8 of block 1. The alternate embodiment of faces, core and proportional surface areas serve to illustrate the non-limiting nature of the various features of block 1.

Although particular embodiments have been disclosed herein in detail, this has been done for purposes of illustration only, and is not intended to be limiting with respect to the scope of the appended claims, which follow. In particular, it is contemplated by the inventor that various substitutions, alterations, and modifications may be made to the invention without departing from the spirit and scope of the invention as defined by the claims. For instance, the choice of materials or variations in the shape or angles at which some of the surfaces intersect are believed to be a matter of routine for a person of ordinary skill in the art with knowledge of the embodiments disclosed herein.

What is claimed is:

1. A retaining wall block comprising:

a block body having top and bottom faces, a front face, a rear face, first and second side wall faces and a vertical plane of symmetry extending between the front and rear faces, the block body having a front portion including the front face, a rear portion including the rear face, a neck portion connecting the front portion and the rear portion, the front, rear and neck portions each extending between the top and bottom faces and between the first and second side wall faces;

a core extending through the neck portion from the top face to the bottom face, the core dividing the neck portion into first and second neck wall members extending rearward from the front portion to the rear portion;

a flange extending downward from the block body beyond the bottom face, the flange extending from the first side wall face to the second side wall face, the flange positioned on the rear portion of the block body, the flange having a front surface, a back surface and a lower surface, the back surface of the flange having an angular planar surface that extends from the rear face towards the lower surface of the flange wherein a portion of the angular planar surface of the back surface of the flange extends a first distance towards the top face into the block body above a horizontal plane of the bottom face and a portion of the front surface of the flange extends a second distance towards the top face into the block body above the horizontal plane of the bottom face, the first distance of the angular planar surface being greater than the second distance of the front surface of the flange;

a channel positioned in the rear portion of the block body and extending from the first side wall face to the second side wall face and opening onto the bottom face, the first side wall face and the second side wall face, the channel having a front surface, an upper surface and a back surface, the back surface of the channel being formed by the front surface of the flange;

wherein the neck wall members are positioned such that a first plane extending parallel to the plane of symmetry passes through the first neck wall member and a second plane extending parallel to the plane of symmetry passes through the second neck wall member and wherein the first and second planes are located approximately midway between the plane of symmetry and lateral outermost points of the first and second side wall faces, respectively; and wherein the lower surface of the flange is inset a distance from the rear face toward the front face of the block body.

2. The retaining wall block of claim 1, wherein the back surface of the flange has a vertical planar surface, the angular planar surface of the flange extending from the rear face of the block body to the vertical planar surface and the vertical planar surface extending from the angular planar surface to the lower surface of the flange.

3. The retaining wall block of claim 2, wherein the flange tapers from an upper portion of the flange to the lower surface of the flange.

4. The retaining wall block of claim 3, wherein the front portion has first and second ears extending laterally beyond the first and second neck wall members, respectively and the rear portion has first and second ears extending laterally beyond the first and second neck wall members, respectively.

5. The retaining wall block of claim 4, wherein the laterally extending first ears of the front and rear portions and the first neck wall member of the first side wall face create a first side wall indentation and the laterally extending second ears of the front and rear portions and the second neck wall member of the second side wall face create a second side wall indentation.

6. The retaining wall block of claim 5, wherein the first and second neck wall members are each positioned so as to align, in use, with the neck wall member of a vertically adjacent retaining wall block in an adjacent course of a wall made from a plurality of courses of the retaining wall blocks laid in a running bond pattern.

7. The retaining wall block of claim 6, wherein the first side wall indentations align, in use, with the second wall indentations of a horizontally adjacent retaining wall block in each course of a wall made from a plurality of courses of the retaining wall blocks laid in a running bond pattern to form a side wall opening.

8. The retaining wall block of claim 7, wherein the core of a retaining wall block in a course of the wall is configured to align, in use, with the side wall opening of a vertically adjacent course of retaining wall blocks to create retaining wall cavities in the wall that are open from the uppermost course of the wall to the lowermost course of the wall.

9. The retaining wall block of claim 1, wherein the back surface of the flange has a smaller lateral width than a lateral width of the front surface of the flange and wherein the back surface of the channel has a smaller lateral width than a lateral width of the front surface of the channel.

10. The retaining wall block of claim 1, wherein a lateral most surface of the rear portion of the first side wall face is in the same vertical plane as a lateral most surface of the front portion of the first side wall face and wherein a lateral most surface of the rear portion of the second side wall face is in the same vertical plane as a lateral most surface of the front portion of the second side wall face.

11. A retaining wall block system comprising:

a plurality of retaining wall blocks having a block body with top and bottom faces, a front face, a rear face, first and second side wall faces and a vertical plane of symmetry extending between the front and rear faces, the block body having a front portion including the front face, a rear portion including the rear face, a neck portion connecting the front portion and the rear portion, the front, rear and neck portions each extending between the top face and the bottom face and between the first and second side wall faces; a core extending through the neck portion from the top face to the bottom face, the core dividing the neck portion into first and second neck wall members extending rearward from the front portion to the rear portion, the neck wall members being positioned such that a first plane extending parallel to the plane of symmetry passes through the first neck wall member and a second plane extending parallel to the plane of symmetry passes through the second neck wall member, the first and second planes being located approximately midway between the plane of symmetry and laterally outermost points of the first and second side wall faces, respectively; a flange extending downward from the block body past the bottom face, the flange extending from the first side wall face to the second side wall face, the flange positioned on the rear portion of the block body, the flange having a front surface, a back surface and a lower surface, the back surface of the flange having an angular planar surface that extends from the rear face towards the lower surface of the flange wherein a portion of the angular planar surface of the back surface of the flange extends a first distance towards the top face into the block body above a horizontal plane of the bottom face and a portion of the front surface of the flange extends a second distance towards the top face into the block body above the horizontal plane of the bottom face, the first distance of the angular planar surface being greater than the second distance of the front surface of the flange; a channel positioned in the rear portion of the block body and extending from the first side wall face to the second side wall face and opening to the bottom face, the first side wall face and the second side wall face, the channel having a front surface, an upper surface and a back surface, the back surface of the channel being formed by the front surface of the flange;

wherein the front portion of the plurality of retaining wall blocks have first and second ears extending laterally beyond the first and second neck wall members, respectively and the rear portion has first and second ears extending laterally beyond the first and second neck wall members, respectively, the laterally extending first ears of the front and rear portions and the first neck wall member of the first side wall face creating a first side wall indentation and the laterally extending second ears of the front and rear portions and the second neck wall member of the second side wall face creating a second side wall indentation and wherein the first and second neck wall members of the plurality of retaining wall blocks are configured to align, in use, with the neck wall members of vertically adjacent retaining wall blocks in an adjacent course of a wall made from a plurality of courses of the retaining wall blocks and the cores of retaining wall blocks in a course of the wall are configured to align, in use, with the side wall indentations of retaining wall blocks in a vertically adjacent course to create retaining wall cavities in the retaining wall that are continuously open from an uppermost course of the retaining wall to a lowermost course of the retaining wall; and wherein the lower surface of the flange of the plurality of retaining wall blocks is inset a distance from the rear face toward the front face of the block body.

12. The retaining wall system of claim 11, wherein the back surface of the flange of the plurality of retaining wall blocks has a vertical planar surface, the angular planar surface of the flange extending from the rear face of the block body to the vertical planar surface and the vertical planar surface extending from the angular planar surface to the lower surface of the flange.

13. The retaining wall block system of claim 11, wherein the back surface of the flange of the plurality of retaining wall blocks has a smaller lateral width than a lateral width of the front surface of the flange and wherein the back surface of the channel has a smaller lateral width than a lateral width of the front surface of the channel.

14. A method of constructing a retaining wall from a retaining wall block system comprising:

providing a plurality of retaining wall blocks having a block body with top and bottom faces, a front face, a rear face, first and second side wall faces and a vertical plane of symmetry extending between the front and rear faces, the block body having a front portion including the front face, a rear portion including the rear face, a neck portion connecting the front portion and the rear portion, the front, rear and neck portions each extending between the top face and the bottom face and between the first and second side wall faces; a core extending through the neck portion from the top face to the bottom face, the core dividing the neck portion into first and second neck wall members extending rearward from the front portion to the rear portion, the neck wall members being positioned such that a first plane extending parallel to the plane of symmetry passes through the first neck wall member and a second plane extending parallel to the plane of symmetry passes through the second neck wall member, the first and second planes being located approximately midway between the plane of symmetry and laterally outermost points of the first and second side wall faces, respectively; a flange extending downward from the block body past the bottom face, the flange extending from the first side wall face to the second side wall face, the flange positioned on the rear portion of the block body, the flange having a front surface, a back surface and a lower surface, the back surface of the flange having an angular planar surface that extends from the rear face towards the lower surface of the flange wherein a portion of the angular planar surface of the back surface of the flange extends a first distance towards the top face into the block body above a horizontal plane of the bottom face and a portion of the front surface of the flange extends a second distance towards the top face into the block body above the horizontal plane of the bottom face, the first distance of the angular planar surface being greater than the second distance of the front surface of the flange; a channel positioned in the rear portion of the block body and extending from the first side wall face to the second side wall face and opening to the bottom face, the first side wall face and the second side wall face, the channel having a front surface, an upper surface and a back surface, the back surface of the channel being formed by the front surface of the flange, wherein the front portion of the plurality of retaining wall blocks have first and second ears extending laterally beyond the first and second neck wall members, respectively and the rear portion has first and second ears extending laterally beyond the first and second neck wall members, respectively, the laterally extending first ears of the front and rear portions and the first neck wall member of the first side wall face creating a first side wall indentation and the laterally extending second ears of the front and rear portions and the second neck wall member of the second side wall face creating a second side wall indentation;

positioning a first plurality of retaining wall blocks to form at least a portion of a first course of blocks;

stacking a second plurality of retaining wall blocks to form at least a portion of a second course of blocks such that the first and second neck wall members of the second plurality of retaining wall blocks align with the first and second neck wall members of the first plurality of retaining wall blocks and the flange of the retaining wall blocks of the second course contact the rear face of the retaining wall blocks of the first course to secure and connect the second course to the first course;

wherein the cores of retaining wall blocks in a course of the wall are configured to align with the side wall indentations of retaining wall blocks in vertically adjacent courses to create retaining wall cavities in the retaining wall that are continuously open from an uppermost course of the retaining wall to a lowermost course of the retaining wall; and wherein the lower surface of the flange of the plurality of retaining wall blocks is inset a distance from the rear face toward the front face of the block body.

15. The method of claim 14, wherein the back surface of the flange of the plurality of retaining wall blocks has a vertical planar surface, the angular planar surface of the flange extending from the rear face of the block body to the vertical planar surface and the vertical planar surface extending from the angular planar surface to the lower surface of the flange.

* * * * *